US005607910A

United States Patent [19]

Sherry et al.

[11] Patent Number: 5,607,910

[45] Date of Patent: Mar. 4, 1997

[54] DETERGENT GELS CONTAINING ETHOXYLATED ALKYL SULFATES AND SECONDARY SULFONATES

[76] Inventors: Alan E. Sherry; John D. Curry, both of 5299 Spring Grove Ave., Cincinnati, Ohio 45217

[21] Appl. No.: 355,765

[22] Filed: Dec. 14, 1994

Related U.S. Application Data

[63] Continuation-in-part of Ser. No. 85,433, Jun. 30, 1993, abandoned.

[51] Int. Cl.[6] ..... C11D 17/00; C11D 1/29; C11D 3/32

[52] U.S. Cl. ..... 510/235; 510/365; 510/403; 510/405; 510/426; 510/427; 510/428; 510/429

[58] Field of Search ..... 252/182, 551, 252/553, 548, 544, DIG. 16

[56] References Cited

U.S. PATENT DOCUMENTS

| | | | |
|---|---|---|---|
| 2,580,713 | 1/1952 | Wood | 252/121 |
| 3,501,409 | 3/1970 | Matson et al. | 252/137 |
| 3,755,206 | 8/1973 | Verdier | 252/545 |
| 3,808,156 | 4/1974 | Gorsich et al. | 252/545 |
| 3,981,826 | 9/1976 | Munro | 252/526 |
| 4,244,840 | 1/1981 | Straw | 252/540 |
| 4,257,908 | 3/1981 | Wixon | 252/135 |
| 4,316,824 | 2/1982 | Pancheri | 252/551 |
| 4,435,317 | 3/1984 | Gerritsen et al. | 252/547 |
| 4,556,509 | 12/1985 | Demangeon et al. | 252/542 |
| 4,615,819 | 10/1986 | Leng et al. | 252/110 |
| 4,680,143 | 7/1987 | Edge et al. | 252/553 |
| 4,692,271 | 9/1987 | Messenger et al. | 252/354 |
| 4,732,707 | 3/1988 | Naik et al. | 252/548 |
| 4,784,800 | 11/1988 | Leng et al. | 252/548 |
| 4,880,569 | 11/1989 | Leng et al. | 252/550 |
| 4,975,218 | 12/1990 | Rosser | 252/117 |
| 5,021,195 | 6/1991 | Machin et al. | 252/545 |
| 5,035,826 | 7/1991 | Durbut et al. | 252/121 |
| 5,096,622 | 3/1992 | Simion et al. | 252/548 |
| 5,320,783 | 6/1994 | Marin et al. | 252/544 |
| 5,378,409 | 1/1995 | Ofosu-Asante | 252/548 |

FOREIGN PATENT DOCUMENTS

| | | | |
|---|---|---|---|
| 1070590 | 1/1980 | Canada | C11D 1/37 |
| 2002095 | 5/1990 | Canada . | |
| 0364880A2 | 4/1990 | European Pat. Off. | C11D 1/66 |
| 0387063A2 | 9/1990 | European Pat. Off. | C11D 1/94 |
| 1437089 | 5/1976 | United Kingdom | C11D 10/02 |
| 2107586A | 5/1983 | United Kingdom | A61K 7/06 |
| 2179055A | 2/1987 | United Kingdom | C11D 17/00 |
| 2179053A | 2/1987 | United Kingdom | C11D 17/00 |
| 2179054A | 2/1987 | United Kingdom | C11D 17/00 |
| WO92/06171 | 4/1992 | WIPO | C11D 17/00 |

OTHER PUBLICATIONS

Ser. No. 08/270,841 Gabriel et al Jul. 5, 1994.
Ser. No. 08/184,731 Curry et al. Jan. 18, 1994.
Ser. No. 08/286,893 Murch et al Aug. 8, 1994.
Ser. No. 08/292,950 Morrall et al. Aug. 18, 1994.
Ser. No. 08/388,130 Sherry et al Feb. 13, 1995.

*Primary Examiner*—Paul Lieberman
*Assistant Examiner*—Necholus Ogden
*Attorney, Agent, or Firm*—Milton B. Graff; Donald E. Hasse; Jacobus C. Rasser

[57] ABSTRACT

The present invention relates to a detergent composition comprising a gel wholly or predominantly in hexagonal liquid crystal phase, said gel comprising:

(a) from about 15% to about 50% ethoxylated alkyl sulfate surfactant by weight of the gel, wherein the alkyl group of the ethoxylated alkyl sulfate surfactant has an average from about 8 to about 20 carbon atoms, and wherein the ethoxylated alkyl sulfate surfactant has an average degree of ethoxylation from about 0.5 to about 15;

(b) from about 1% to about 20%, by weight of the gel, secondary sulfonate surfactant selected from the group consisting of alkylbenzene sulfonates, alkyltoluene sulfonates, paraffin sulfonates, olefin sulfonates, alpha-sulfonated fatty acid alkyl esters, and mixtures thereof;

(c) optionally from 0% to about 15% other surfactants by weight of the gel;

(d) from about 40% to about 80% water by weight of the gel;

(e) from about 0.2% to about 3% magnesium ions by weight of the gel; and (f) less than 1% hydrotropes by weight of the gel;

wherein the weight ratio of surfactant (a) to surfactant (b) is between about 3:2 and about 10:1, and wherein the total amount of surfactants (a)+(b)+(c) is from about 25% to about 60% by weight of the gel.

15 Claims, No Drawings

DETERGENT GELS CONTAINING ETHOXYLATED ALKYL SULFATES AND SECONDARY SULFONATES

This is a continuation-in-part of application Ser. No. 08/085,433, filed on Jun. 30, 1993, now abandoned.

FIELD OF THE INVENTION

This invention relates to detergent compositions, in particular detergents in the form of gels in hexagonal liquid crystal phase. A preferred embodiment of the invention is dishcare gels.

BACKGROUND OF THE INVENTION

Detergents in gel form can present many advantages, for example, ease of use and concentrated cleaning ability. Dishcare gels are preferred for use in washing dishes in some parts of the world. The gel product form best lends itself to the "direct application" habit in which persons apply a wet sponge or other cleaning applicator directly onto the dishcare detergent and then onto the dishes; the dishes are then typically washed and rinsed under running water. Additionally, dishcare gels can be stored in inexpensive tubs or similar packages instead of the more complex plastic bottles required for dishwashing liquids.

It is important for detergent gels to have excellent sudsing properties, and to provide good cleaning and other performance benefits. It is also desirable for detergent gels to have an attractive appearance and to be easy to process. Moreover, it is desirable to make such detergent gels from ingredients that are relatively inexpensive so that the detergent gels are affordable to consumers.

U.S. Pat. No. 4,615,819 issued to Leng, Machin, Reed and Erkey on Oct. 7, 1986 discloses detergent gel compositions in hexagonal liquid crystal form. This patent requires, as an essential component of its gels, an additive which is a water-soluble non-micelle-forming or weakly micelle-forming material capable of forcing the surfactant system of the product into hexagonal phase. The patent states that without this additive the transition into the hexagonal phase will not take place. The additives disclosed in this patent, as being capable of forcing such hexagonal phase, are materials useful as hydrotropes in light-duty liquid detergent compositions. These additives contain a large polar group and, optionally, a small hydrophobic group, such as an aliphatic or araliphatic chain containing not more than 6, preferably 4 or less, aliphatic carbon atoms. The larger the polar head group, the larger hydrophobe that can be tolerated. The polar group of the additive may carry an ionic charge, but if so it must be of the same polarity as that of the surfactants in the product. Such hydrotropes disclosed in the patent include short-chain analogs of surfactants, such as lower aryl or alkylaryl sulfonates, i.e., toluene and xylene sulphonates. Preferred hydrotrope additives disclosed have the same or a similar polar group as the surfactant used in the gel, but with a relatively short hydrocarbon chain containing at most 6, and preferably not more than 4, aliphatic carbon atoms. Other preferred hydrotrope additives disclosed include short chain ammonium salts, such as triethanolamine hydrochloride or lower alkylbenzene dimethyl ammonium hydrochlorides when the surfactant of the product is cationic. Also preferred hydrotrope additives disclosed are highly polar but uncharged materials which may be used in conjunction with both anionic and cationic surfactants in the product. Short chain analogues of nonionic surfactants are also disclosed as such additives. Other preferred uncharged hydrotrope additives disclosed are lower amides, especially urea. Short-chain urea homologues and analogues, for example, methyl and ethyl ureas, thiourea, formamide and acetamide, are other hydrotrope additives disclosed.

It is an object of the present invention to provide detergent compositions in the form of gels.

It is a particular object of the present invention to make detergent gels that have excellent sudsing characteristics, including a large amount of rich, long-lasting suds.

It is also an object of the present invention to make detergent gels that provide good cleaning and other performance benefits in addition to the excellent sudsing.

It is another object of the present invention to provide detergent gels that have an attractive appearance and that are easy to process.

It is a further object of the present invention to make such gels from relatively inexpensive ingredients so that the gels are affordable to consumers.

These and other objects of the invention will be described in further detail herein.

SUMMARY OF THE INVENTION

The present invention relates to a detergent composition comprising a gel wholly or predominantly in hexagonal liquid crystal phase, said gel comprising:

(a) from about 15% to about 50% ethoxylated alkyl sulfate surfactant by weight of the gel, wherein the alkyl group of the ethoxylated alkyl sulfate surfactant has an average from about 8 to about 20 carbon atoms, and wherein the ethoxylated alkyl sulfate surfactant has an average degree of ethoxylation from about 0.5 to about 15;

(b) from about 1% to about 20%, by weight of the gel, secondary sulfonate surfactant selected from the group consisting of alkylbenzene sulfonates, alkyltoluene sulfonates, paraffin sulfonates, olefin sulfonates, alpha-sulfonated fatty acid alkyl esters, and mixtures thereof;

(c) optionally from 0% to about 15% other surfactants by weight of the gel;

(d) from about 40% to about 80% water by weight of the gel;

(e) from about 0.2% to about 3% magnesium ions by weight of the gel; and (f) less than 1% hydrotropes by weight of the gel;

wherein the weight ratio of surfactant (a) to surfactant (b) is between about 3:2 and about 10:1, and wherein the total amount of surfactants (a)+(b)+(c) is from about 25% to about 60% by weight of the gel.

DETAILED DESCRIPTION OF THE INVENTION

Gels in hexagonal liquid crystal phase are particularly suitable for use as detergent gels, because they have desirable viscosity and consistency, are stable, and have a good appearance. Many surfactants in water undergo phase changes from micellar to hexagonal to lamellar phase as a function of surfactant concentration at a given temperature and pressure. Ethoxylated alkyl sulfates surfactants in water, for example, generally display hexagonal phase regions at from about 25–30% concentration to about 60–65% concentration by weight at ambient temperature and pressure. Unfortunately, detergent gels made from ethoxylated alkyl sulfate surfactants alone do not provide very good cleaning or sudsing properties.

Secondary sulfonates surfactants such as alkylbenzene sulfonates, alkyltoluene sulfonates, paraffin sulfonates, olefin sulfonates, and alpha-sulfonated fatty acid alkyl esters do not have well-defined hexagonal phase regions in water at ambient temperature and pressure. Instead, these surfactants are predominantly in the lamellar phase or in a lamellar phase emulsion even at low surfactant concentrations. It has now been discovered that by combining ethoxylated alkyl sulfate surfactants at a concentration where they are present in a micellar phase near the hexagonal phase boundary (i.e., about 15–30% surfactant concentration by weight), with secondary sulfonates surfactants present that display predominantly lamellar phase behavior, exist as lamellar phase emulsions, or as crystals in water, hexagonal phase gels are formed. While not intending to be limited by theory, it is believed that such hexagonal phase gels result from a "phase averaging effect", i.e., a phase averaging of the micellar phase and other phase compositions to form a hexagonal phase composition.

Importantly, it has also been found that these hexagonal phase detergent gels, containing such secondary sulfonate surfactants in combination with ethoxylated alkyl sulfate surfactants, provide excellent sudsing and good cleaning when the gels also contain small amounts of magnesium ions. Moreover, the secondary sulfonate surfactants are relatively inexpensive so that the detergent gels are readily affordable to consumers. The detergent gel compositions are easy to manufacture because processing of the compositions usually takes place at elevated temperature where the surfactant mixture is liquid, and not in the hexagonal gel phase; upon cooling to room temperature, the compositions enter the hexagonal phase. The detergent gels of this invention do not require additives such as urea to force the compositions into the hexagonal phase. Instead, the hexagonal phase results from mixing of the surfactants in the proportions disclosed herein.

A detergent gel composition according to the present invention comprises from about 15% to about 50% ethoxylated alkyl sulfate surfactant by weight of the detergent gel, preferably from about 20% to about 45% ethoxylated alkyl sulfate. An ethoxylated alkyl sulfate surfactant, $AE_xS$, is one having, on average, "x" degree of ethoxylation. The ethoxylated alkyl sulfate surfactant for use in the present invention has an average degree of ethoxylation from about 0.5 to about 15, and preferably from about 1 to about 6.5. The alkyl group of the ethoxylated alkyl sulfate surfactant can have an average from about 8 to about 20 carbon atoms, preferably from about 8 to about 15 carbon atoms, and most preferably from about 12 to about 15 carbon atoms. The alkyl groups are preferably linear, but they can also be branched.

Blends of different ethoxylated alkyl sulfate surfactants can be used, for example a blend of two surfactants having different degrees of ethoxylation. In general, highly ethoxylated surfactants (e.g., ethoxylation of 3 or more) provide more mildness to skin, while mono- and di-ethoxylated surfactants contribute more to cleaning ability. As a result, it may be desirable to use a blend of $AE_1S$ and $AE_3S$ or similar blends to provide the optimum combination of cleaning and mildness. Variation in degrees of ethoxylation of the surfactants provides broad formulation flexibility.

The cation of the ethoxylated alkyl sulfate surfactant can be sodium, potassium, lithium, calcium, magnesium, ethylene diamine, ammonium, aluminum, zinc, or lower alkanol ammonium ions, and other cations which are known in the detergent field to be useful in surfactants. As will be discussed below, most preferred are magnesium cations. The preferred magnesium ethoxylated alkyl sulfate surfactant can be either introduced as a raw material, or it can be generated in situ through counterion exchange with $Mg^{++}$ salts (this can also be done for the surfactants with less preferred cations).

Preferred ethoxylated alkyl sulfate surfactants according to the present invention include those where the alkyl group is derived from coconut or palm base, such as mid-cut coconut ($C_{12-14}$) or broad-cut coconut ($C_{12-18}$). Surfactants of the $C_{12-14}$ type are available commercially from Akzo Chemicals, 516 Duren, Germany, under the tradename ELFAN NS 243 S Mg conc. ($Mg^{++}$ cation, alkyl group having an average chain length of $C_{12-14}$, average degree of ethoxylation of 3).

Synthetic ethoxylated alkyl sulfate surfactants (derived from synthetic alcohols) such as those containing $C_{12-13}$ or $C_{12-15}$ alkyl groups are also preferred. Such synthetic surfactants are commercially available from South Pearl Corp., Ponce, Puerto Rico, 00731 and other suppliers. Specific examples of preferred surfactants are $Mg(C_{12-14}AE_2S)_2$, $Mg(C_{12-15}AE_3S)_2$, $Mg(C_{12-13}AE_3S)_2$, and their counterparts having other degrees of ethoxylation. Other suitable surfactants include, but are not limited to, ethoxylated alkyl sulfate surfactants where the alkyl group is lauryl ($C_{12}$) or myristyl ($C_{14}$).

The ethoxylated alkyl sulfate surfactant used in the detergent gel is preferably a high active surfactant. By "high active" surfactant is meant the surfactant has at least about 60% active content, preferably at least about 65%. At above 60–65% activity, ethoxylated alkyl sulfate surfactants are easily processable lamellar phase materials. Most preferred are high active surfactants that contain little or no alcohols, glycols, inorganic salts or hydrotropes. Ethoxylated alkyl sulfate surfactant stocks which are not "high active" will necessarily contain additives such as alcohols and glycols, or hydrotropes such as toluene, xylene and cumene sulfonates. The ethoxylated alkyl sulfate surfactant stocks of this invention should contain little or no short chain alcohols and glycols ($C_6$ or lower), preferably less than about 10% by weight, most preferably less than about 5% by weight. Additionally, they should contain little or no hydrotropes, preferably less than about 5% by weight, most preferably less than about 2% by weight. Without limiting the scope of this invention, it has been found that stable hexagonal phase gels can be made in the presence of small quantities of alcohols, glycols and/or hydrotropes, but these gels usually require higher surfactant concentrations. The gels do not contain additives such as urea, thiourea, methyl urea or ethyl urea to force the surfactant system into the hexagonal phase.

It has been found that the hydrotrope additives incorporated in detergent gel products for the purpose of forcing the surfactant system into hexagonal phase, according to U.S. Pat. No. 4,615,819 described above, are undesirable for cost and/or aesthetic reasons. Many of such additives cause undesirable odor of the product. The subject invention gel products have wholly or predominantly the desired hexagonal phase liquid crystal form, without incorporation of such hydrotrope additives. The detergent gels of the subject invention preferably contain less than 1% of, more preferably are substantially free of, such hydrotrope additives.

The detergent gel of the present invention also comprises from about 1% to about 20%, by weight of the gel, secondary sulfonates surfactants selected from the group consisting of alkylbenzene sulfonates, alkyltoluene sulfonates, paraffin sulfonates, olefin sulfonates, alpha-sulfonated fatty acid alkyl esters, and mixtures thereof. Preferably the detergent gel comprises from about 5% to about 15% secondary sulfonates surfactants by weight of the gel. Preferred secondary sulfonate surfactants are selected from the group consisting of alkylbenzene sulfonates, paraffin sulfonates, and mixtures thereof. Most preferred are alkylbenzene sulfonates.

Suitable alkylbenzene or alkyltoluene sulfonates include alkali metal (lithium, sodium, and/or potassium), alkaline earth (preferably magnesium), ammonium and/or alkanolammonium salts of straight or branched chain alkylbenzene or alkyltoluene sulfonic acids in which the alkyl group contains from about 9 to about 15 carbon atoms. Alkylbenzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid and mixtures thereof. Preferred sulfonic acids as precursors of the alkylbenzene sulfonates useful for compositions herein are those in which the alkyl chain is linear and averages about 11 to 13 carbon atoms in length, most preferably from about 11.3 to about 12.3 carbon atoms in length. Examples of commercially available alkyl benzene sulfonic acids useful in the present invention include Conoco SA 515 and SA 597 marketed by the Continental Oil Company and Calsofi LAS 99 marketed by the Pilot Chemical Company.

Also suitable for use as the secondary sulfonates surfactants are paraffin sulfonates having from about 8 to about 22 carbon atoms, preferably from about 12 to about 16 carbon atoms, in the alkyl moiety. A suitable commercially available paraffin sulfonate useful in the present invention is Hostapur SAS 60 marketed by the Hoechst Celanese Corp.

The secondary sulfonate surfactants can also be olefin sulfonates, which are compounds produced by the sulfonation of alpha-olefin by means of uncomplexed sulfur trioxide followed by neutralization of the acid reaction mixture under conditions such that suitones formed in the reaction are hydrolyzed to give corresponding hydroxyalkanesulfonates. The alpha-olefins from which the olefin sulfonates are derived are mono-olefins having from about 12 to about 24 carbon atoms, preferably from about 14 to about 16 carbon atoms. Preferably, they are straight chain olefins. Examples of suitable 1-olefins include 1-dodecene, 1-tetradecene, 1-hexadecene, 1-octadecene, 1-eicosene and 1-tetracosene.

The secondary sulfonate surfactants can also be alpha-sulfonated fatty acid alkyl ester surfactants having the general formula:

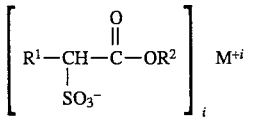

wherein $R^1$ is straight or branched alkyl having from about 8 to about 20 carbon atoms; $R^2$ is straight or branched alkyl having from about 1 to about 6 carbon atoms; M represents a counter-ion such as sodium, potassium, magnesium, ammonium and alkanolammonium, and i is either 1 or 2 depending on whether the counter-ion is mono- or divalent. Preferred is an ester salt wherein $R^1$ is $C_{10-16}$ alkyl, $R^2$ is methyl, and M is Na or K.

The weight ratio of the ethoxylated alkyl sulfate surfactant to the secondary sulfonate surfactant should be between about 3:2 and about 10:1, preferably between about 2:1 and 5:1. Hexagonal phase gels are not formed when the ratio of ethoxylated alkyl sulfate surfactant to secondary sulfonate surfactant is less than 3:2, while cleaning and sudsing properties of the hexagonal phase gels are poor when the ratio is greater than 10:1.

Along with the ethoxylated alkyl sulfate and secondary sulfonate surfactants, the present detergent gel composition can also optionally contain from 0% to about 15% other surfactants by weight of the gel. The other surfactants can be anionic, cationic, nonionic, zwitterionic, ampholytic or amphoteric surfactants known to persons skilled in the art. Preferably not more than about 5% by weight cationic surfactant is used. Preferred optional surfactants are nonionic. Nonionic surfactants useful in the detergent gel of this invention include ethoxylated fatty alcohols, the fatty acyl ethanolamides, alkyl phenols, polypropylene oxides, polyethylene oxides, copolymers of polypropylene oxide and polyethylene oxide, sorbitan esters, and the like.

Amine oxides and/or betaines can be optional surfactants, each at a level of up to about 0.5% by weight of the gel. Higher levels of amine oxides and/or betaines weaken gel viscosity and complicate processing. Amine oxides are described in U.S. Pat. No. 4,316,824 to Pancheri, which is incorporated herein by reference. The Procter & Gamble Company, Cincinnati, Ohio, manufactures suitable amine oxides such as $C_{10-16}$ (predominantly $C_{12}$) alkyl dimethyl amine oxides. The $C_{12}$, $C_{14}$, $C_{16}$, $C_{14-16}$, and $C_{16-18}$ alkyl dimethyl amine oxides are available commercially from Stepan Chemical Company under the tradename Ammonyx. Betaines are disclosed in U.S. Pat. Nos. 3,950,417, 4,137,191; 4,375,421; and 4,555,360; all of which are incorporated herein by reference. Examples of preferred betaines are cetyl dimethyl betaine, dodecyl dimethyl betaine, coco amidopropyl betaine, dodecyl amidopropyldimethyl betaine, and dodecyldimethylammonium hexanoate.

The total amount of surfactants in the present detergent gel composition should be from about 25% to about 60% by weight of the gel. By "total amount of surfactants" is meant the total amount of ethoxylated alkyl sulfate surfactant, secondary sulfonate surfactant, and any optional surfactant used in the detergent gel. At least about 25% total surfactant is needed to make a suitably thickened gel. Above about 60% total surfactant, processing becomes more difficult and the mixture may not exist in the hexagonal phase. A detergent gel composition according to the present invention preferably contains from about 25% to about 50% total surfactant, and most preferably from about 30% to about 40%.

A detergent gel composition according to the invention also contains from about 40% to about 80% water by weight of the gel, preferably from about 45% to about 70%, and most preferably from about 50% to about 65%.

A detergent gel according to the present invention contains from about 0.2% to about 3% magnesium ions by weight of the gel. At least about 0.2% magnesium ions are needed to ensure satisfactory cleaning performance of the detergent gel, and the magnesium ions also enhance sudsing performance. If the product contains more than about 3% magnesium ions it is difficult to obtain a gel since additional magnesium ions would need to be introduced as magnesium salts which are electrolytes that weaken the gel structure. The magnesium ions are preferably introduced by use of magnesium neutralized ethoxylated alkyl sulfate surfactants, secondary sulfonate surfactants, and/or optional surfactants. Less preferably for the above-mentioned reason, magnesium ions can also be added in the form of salts, for example, magnesium sulfate, magnesium formate or magnesium chloride; magnesium salts may also be introduced as impurities in the surfactants used (for example, magnesium sulfate impurity is usually present in a magnesium ethoxylated alkyl sulfate surfactant as a result of the synthesis process).

The detergent gel compositions of this invention can be clear or opaque

The detergent gels can be prepared in any suitable manner, for instance by simply mixing together the components. The gels are easily processable as fluid mixtures at temperatures of 150° F. (65.6° C.) to 210° F. (98.9° C.), preferably about 170° F. (76.7° C.) to 200° F. (93.3° C.). The order of mixing of the components is not critical, but a preferred order of addition is to add water first, then ethoxylated alkyl sulfate surfactant and magnesium ions, then nonionic surfactant (if any), and lastly secondary sulfonate surfactant. Abrasives can be added, if desired, at any time during the processing. Upon cooling, the compositions become viscous and set up as hexagonal phase gels.

The following nonlimiting examples are performed using water at a 6–12 grains per gallon hardness. All percentages herein are by weight unless otherwise defined.

EXAMPLE 1

A detergent gel most preferred for its excellent sudsing and good cleaning properties is made as follows. To 20.00 grams of $Mg(LAS)_2$ (50% active made by Hoechst, Venezuela), 41.02 grams of water and 6.00 grams of silica (100% active Zeodent 119 made by J. M. Huber, USA) are added at about 74° F. (23.3° C.). The mixture is then well mixed and heated to 180° F. (82.2° C.). 32.98 grams $Mg(C_{12-13}AE_2S)_2$ (66.7% active made by South Pearl Corp., Puerto Rico, USA) are added and the mixture stirred for 4 hours. The final produce is a viscous opaque fluid which quickly forms a gel upon cooling to room temperature. X-ray diffraction identifies the gel phase as predominantly hexagonal. The composition of the gel is 22% $Mg(AE_2S)_2$, 10% $Mg(LAS)_2$, 6% precipitated silica, and 62% water. The gel contains 1.0% magnesium ions. The viscosity of the gel is 3,200,000 cps. The IFT (interfacial tension) of the detergent gel is 1.0 dynes/cm.

IFT is measured by use of a Model 500 Spinning Drop Interfacial Tensiometer with a 2 mm I.D.×95 mm long capillary tube with cap (both manufactured by the University of Texas, Austin, Tex.). The "soil" used for the IFT measurement is 99.8% Puritan® Canola Oil (Procter & Gamble, Cincinnati, Ohio) and 0.2% oleic acid. The process is as follows:

1. Prepare 100 to 150 grams of a 6% product solution of the detergent gel in distilled water ("soft" water, 3 gpg hardness or less).
2. Let the solution equilibrate to 25° C.
3. Flush the capillary tube three times with product solution using a 10 cc disposable syringe.
4. Invert the capillary tube to an approximate 30° angle.
5. Flush a 0.005 ml microsyringe with the "soil" described above.
6. Inject the soil: Add enough soil to elongate it four times its width (see #12).
7. Put the cap on the capillary tube making sure no air bubbles enter the tube.
8. Dry the tube, especially around the cap area.
9. Making sure the oil droplet is in the center of the tube, insert the tube into the IFT machine and tighten.
10. Turn on the power and then the strobe light.
11. Locate and center the oil droplet and tighten the eyepiece accordingly.
12. Increase the speed until the oil droplet elongates to four times its width. (The speed cannot go below 7.00 msec./rev.)
13. Start the timer.
14. Measure and record the readings for the top and bottom of the oil droplet as well as the initial speed and the speed after 2, 4, 6 and 10 minutes.
15. The average IFT is the average of the calculated IFT values at 0, 2, 4, 6 and 10 minutes. IFT is calculated by the equation: $IFT=52{,}100\times[(\text{top reading-bottom reading})^3]\div(\text{speed}^2)$.

EXAMPLE 2

70.0 grams of $NaC_{12}AE_3S$ solution (28.5% sodium neutralized alkyl ethoxy sulfate with an average of 3 moles of ethoxy groups per mole of surfactant, Steol 4N made by Stepan Chemical Company, USA) and 0.20 grams of $MgSO_4$ (99% active) are stirred together at 150° F. (65.6° C.) using a Labmaster 1500 MSV 1500 U mixer. Once all of the $MgSO_4$ is dissolved, 0.10 grams of a 1% solution of blue dye, 0.50 grams of perfume, and 9.20 grams of water are added and the mixture is vigorously stirred. The temperature is raised to 170° F. (76.7° C.) and 20.0 grams of $Mg(C_{11.8}LAS)_2$ (50% active, linear alkylbenzene sulfonate made by Hoechst Corp., Venezuela) are added. The resulting mixture is stirred for 2 hours at 170° F. (76.7° C.) to achieve homogeneity. The final product is a viscous liquid which forms a gel upon cooling to room temperature. The gel is identified as predominantly hexagonal phase by X-ray diffraction. The composition of the gel is 20% $NaAE_3S$, 10% $Mg(LAS)_2$, 0.2% $MgSO_4$, 69.3% water, 0.5% perfume and 0.001% dye. The gel contains 0.4% magnesium ions. The viscosity of the gel is 1,700,000 cps.

EXAMPLE 3

To 49.53 grams of water (8 gpg hardness), 13.33 grams of paraffin sulfonate (60% active, Hostapur SAS 60, sodium neutralized secondary alkane sulfonate made by Hoechst, USA) and 37.14 grams of $Mg(C_{12-14}AE_3S)_2$ (70% active magnesium neutralized $C_{12-14}$ triethoxylated alkyl sulfate surfactant made by Akzo Chemical Co., Germany) are added and mixed together at 190° F. (87.8° C.). The product is continuously stirred until a homogeneous solution is obtained. The final product is a clear, water white liquid which forms a gel upon cooling to room temperature. The composition of the gel is 26% $Mg(C_{12-14}AE_3S)_2$, 8% paraffin sulfonate, and 64% water. The gel contains 0.75% magnesium ions. The viscosity of the gel is 3,000,000 cps. The gel is identified as predominantly in the hexagonal phase by X-ray diffraction.

EXAMPLE 4

To 49.24 grams of water, 13.33 grams of paraffin sulfonate (60% active Hostapur SAS 60 made by Hoechst USA), 31.43 grams of $Mg(AE_3S)_2$ (70% active, made by Akzo Chemical, Germany), and 6% precipitated silica (100% active Zeodent 119 made by J. M. Huber, USA) are added sequentially and mixed at 190° F. (87.8° C.). The mixing is continued until the $Mg(AE_3S)_2$ is completely dissolved and the silica is well dispersed in the mixture. The final product is a white fluid composition that forms an opaque gel upon cooling to is room temperature. X-ray diffraction identifies the phase of the gel as predominantly hexagonal. The composition of the gel is 22% $Mg(AE_3S)_2$, 8% paraffin sulfonate, 6% silica and 64% water. The gel contains 0.6% magnesium ions. The viscosity of the gel is 2,600,000 cps.

The detergent products of Examples 1–4 are tested for their sudsing properties by the use of an apparatus consisting of 8 tubes (cylinders) of length 30 cm. and diameter 10 cm. fixed side by side, and rotatable at a speed of 24 rpms about a central axis. Each tube can be charged with 500 ml. of product solution. In short, 0.2% solutions of the products of Examples 1–4 and a control product are inserted into five of the tubes, the tubes are rotated 20 times, and the height of the suds is measured in each of the tubes. One ml. of test soil is injected into each of the tubes containing the product solutions, the tubes are rotated 20 more times, and the height of the suds is again measured. This is repeated with further additions of 1 ml. increments of test soil until the suds are diminished. Following is the procedure in more detail:

1. Prepare test soil: Melt 100 grams of test soil in a water bath using low heat. The test soil is composed of 12.7% Crisco® oil, 27.8% Crisco®shortening, 7.6% lard, 51.7% beef suet, 0.14% oleic acid, 0.04% palmitic acid and 0.02% stearic acid.
2. Prepare product solutions: Prepare 500 ml. product solutions at 0.2% concentration using tap water at ambient temperature. The products of Examples 1–4 and one control product are tested. The control product is a commercial detergent gel product containing, as the surfactant, about 36% linear alkylbenzene sulfonate surfactant and about 1% ethoxylated alkyl sulfate surfactant. The control product is known to have very good sudsing properties.
3. Make sure the tubes of the apparatus are clean by rinsing them with distilled water.
4. Pour product solutions into the tubes and replace tube lids.
5. Secure the tubes in the apparatus.
6. Rotate the tubes 20 times at 24 rpm's.
7. Measure the suds height in each of the tubes.
8. Inject 1 ml of melted test soil into each tube.
9. Repeat 6–8 until the suds are diminished.

| | SUDS HEIGHT IN MILLIMETERS AFTER 20 TUBE ROTATIONS PER SOIL LOADING | | | | | | | | | | | | | | |
|---|---|---|---|---|---|---|---|---|---|---|---|---|---|---|---|
| | ML. OF SOIL ADDED | | | | | | | | | | | | | | |
| PRODUCTS | 0 | 1 | 2 | 3 | 4 | 5 | 6 | 7 | 8 | 9 | 10 | 11 | 12 | TOTAL | SUDS INDEX |
| Control | 49 | 56 | 51 | 55 | 54 | 38 | 24 | 11 | 8 | 5 | | | | 351 | 100.0 |
| Example 1 | 64 | 71 | 64 | 82 | 89 | 59 | 60 | 39 | 26 | 13 | 5 | | | 572 | 163.0 |
| Example 2 | 60 | 65 | 63 | 76 | 77 | 60 | 66 | 45 | 33 | 19 | 11 | 8 | 6 | 589 | 167.8 |
| Example 3 | 59 | 67 | 58 | 67 | 50 | 29 | 21 | 15 | 10 | 8 | 7 | 7 | | 398 | 113.4 |
| Example 4 | 60 | 64 | 58 | 61 | 44 | 22 | 17 | 10 | 8 | 6 | | | | 350 | 99.7 |

The "Suds Index" is the total suds of each test product divided by the total suds of the control product. It is seen from the results that the detergent gel products of Examples 1–4 provide excellent sudsing, particularly the detergents of Examples 1 and 2.

EXAMPLE 5

This example illustrates that nonionic surfactants can optionally be used in the present detergent gels. 30.0 grams of $Mg(C_{11.8}LAS)_2$ (50% active, made by Hoechst, Venezuela), 47.12 grams of $NaC_{12-14}AE_2S$ (70% active, Genapol ZRO-V, made by Hoechst, Venezuela), 1.87 grams of $C_{10-16}$ dimethyl amine oxide (32% active, made by Procter & Gamble, USA), and 15.00 grams of alkyl ethoxylated alcohol ($C_{12-15}$, average of three ethoxylate groups per molecule, Neodol 25-3S made by Shell, USA) are mixed at 185° F. (85° C.). 122.95 grams of water are added, and the solution stirred continuously at 185° F. (85° C.). After the solution is made completely homogeneous, 80.76 grams of $NaC_{12-14}AE_1S$ (26% active Genapol ZRO 1-V is made by Hoechst, Venezuela) are added at the same temperature. The final product is a viscous liquid which quickly solidifies into a gel upon cooling to room temperature. The composition of the gel is 7% $NaAE_1S$, 11% $NaAE_2S$, 5% $Mg(LAS)_2$, 5% Neodol, and 0.2% $C_{10-16}$ amine oxide. The gel contains 0.2% magnesium ions.

EXAMPLE 6

The following table demonstrates that the level of amine oxide should be limited to avoid weakening gel strength of $Mg(LAS)_2/AE_xS$ formulations according to the invention.

| | (1) | (2) | (3) | (4) |
|---|---|---|---|---|
| $Mg(C_{12-14}AE_3S)_2$ | 24% | 24% | 24% | 24% |
| $Mg(C_{11.8}LAS)_2$ | 8% | 8% | 8% | 8% |
| $C_{10-16}$ Amine Oxide | 0% | 1% | 2% | 4% |
| Water | 68% | 67% | 66% | 64% |
| Gel Viscosity | 1.0 million centipoise | 0.8 million centipoise | 0.6 million centi-poise | Liquid Product |

EXAMPLE 7

The following compositions are additional hexagonal phase gels that further illustrate the invention:

a) 13.0% $NaC_{12-13}AE_2S$, 17% $Mg(C_{11.8}LAS)_2$, 2.2% $NaAE_1S$ and 67.8% water;

b) 30.0% $NaC_{12-14}AE_3S$, 8.0% $Mg(C_{11.8}LAS)_2$, 30.0% glycerine, 0.72% $Mg(OH)_2$, 1.53% citric acid and 29.75% water;

c) 23.5% $Mg(AE_3S)_2$, 8.5% potassium methyl ester sulfonate and 68.0% water.

What is claimed is:

1. A detergent composition comprising a gel wholly or predominantly in hexagonal liquid crystal phase, said gel comprising:

(a) from about 15% to about 50% ethoxylated alkyl sulfate surfactant by weight of the gel, wherein the alkyl group of the ethoxylated alkyl sulfate surfactant has an average from about 8 to about 20 carbon atoms, and wherein the ethoxylated alkyl sulfate surfactant has an average degree of ethoxylation from about 0.5 to about 15;

(b) from about 1% to about 20%, by weight of the gel, secondary sulfonate surfactant selected from the group consisting of alkylbenzene sulfonates, alkyltoluene sulfonates, paraffin sulfonates, olefin sulfonates, alpha-sulfonated fatty acid alkyl esters, and mixtures thereof;

(c) optionally from 0% to about 15%, by weight of the gel, surfactants selected from the group consisting of cationic surfactants, zwitterionic surfactants, ampholytic surfactants, amphoteric surfactants, nonionic surfactants that are not ethoxylated alkyl sulfate surfactants, artionic surfactants that are not secondary sulfonate surfactants, and mixtures thereof;

(d) from about 40% to about 80% water by weight of the gel; and (e) from about 0.2% to about 3% magnesium ions by weight of the gel;

wherein the gel has a weight ratio of surfactant (a) to surfactant (b) between about 3:2 and about 10:1, a total amount of surfactants (a)+(b)+(c) of from about 25% to about 60% by weight of the gel, and a viscosity of from about 500,000 cp to about 6,000,000 cp; the composition being free of hydrotropes, hydrotropes being water-soluble non-micelle-forming or weakly micelle-forming materials, which contain a large polar group and a small hydrophobic group containing not more than 6 aliphatic carbon atoms, selected from the group consisting of aryl or lower alkylaryl sulfonates, lower alkyl or alkylbenzyl ammonium salts, and lower amides.

2. The composition of claim 1 wherein the secondary sulfonate surfactant is selected from the group consisting of alkylbenzene sulfonates, alkyltoluene sulfonates, paraffin sulfonates, olefin sulfonates, and mixtures thereof.

3. The composition of claim 2 wherein the total amount of surfactants (a)+(b)+(c) is from about 25% to about 50% by weight of the gel.

4. The composition of claim 3 which contains from about 20% to about 45% ethoxylated alkyl sulfate surfactant by weight of the gel.

5. The composition of claim 4 wherein the alkyl group of the ethoxylated alkyl sulfate surfactant has an average from about 8 to about 15 carbon atoms, and wherein the ethoxylated alkyl sulfate surfactant has an average degree of ethoxylation from about 1 to about 6.5.

6. The composition of claim 3 wherein the secondary sulfonate surfactant is selected from the group consisting of alkylbenzene sulfonates, paraffin sulfonates, and mixtures thereof.

7. The composition of claim 5 wherein the secondary sulfonate surfactant is an alkylbenzene sulfonate.

8. The composition of claim 2 wherein the weight ratio of surfactant (a) to surfactant (b) is between about 2:1 and 5:1.

9. The composition of claim 7 wherein the weight ratio of surfactant (a) to surfactant (b) is between about 2:1 and 5:1.

10. The composition of any of claims 1, 3, 5, 6, 8 or 9 wherein the gel contains substantially no hydrotropes.

11. A detergent composition comprising a gel wholly or predominantly in hexagonal liquid crystal phase, said gel comprising:

(a) from about 15% to about 50% ethoxylated alkyl sulfate surfactant by weight of the gel, wherein the alkyl group of ethoxylated alkyl sulfate surfactant has an average from about 8 to about 20 carbon atoms, and wherein the ethoxylated alkyl sulfate surfactant has an average degree of ethoxylation from about 0.5 to about 15;

(b) from about 1% to about 20%, by weight of the gel, secondary sulfonate surfactant selected from the group consisting of alkylbenzene sulfonates, alkyltoluene sulfonates, paraffin sulfonates, olefin sulfonates, alpha-sulfonated fatty acid alkyl esters, and mixtures thereof;

(c) optionally from 0% to about 15%. by weight of the gel, surfactants selected from the group consisting of cationic surfactants, zwitterionic surfactants, ampholytic surfactants, amphoteric surfactants, nonionic surfactants that are not ethoxylated alkyl sulfate surfactants, anionic surfactants that are not secondary sulfonate surfactants, and mixtures thereof;

(d) from about 40% to about 80% water by weight of the gel; and (e) from about 0.2% to about 3% magnesium ions by weight of the gel;

wherein the gel has a weight ratio of surfactant (a) to surfactant (b) between about 3:2 and about 10:1, a total amount of surfactants (a)+(b)+(c) of from about 25% to about 60% by weight of the gel; and wherein the composition contains no hydrotropes, hydrotropes being water-soluble non-micelle-forming or weakly micelle-forming materials, which contain a large polar group and a small hydrophobic group containing not more than 6 aliphatic carbon atoms, selected from the group consisting of aryl or lower alkylaryl sulfonates, lower alkyl or alkylbenzyl ammonium salts, and lower amides.

12. The composition of claim 11 wherein the total amount of surfactants (a)+(b)+(c) is from about 25% to about 50% by weight of the gel, and the weight ratio of surfactant (a) to (b) is between about 2:1 and 5:1.

13. The composition of claim 12 wherein the secondary sulfonate surfactant is an alkylbenzene sulfonate.

14. The composition of claim 13 wherein the composition comprises from about 20% to about 45% ethoxylated alkyl sulfate surfactant by weight of the gel.

15. The composition of claim 14 wherein the alkyl group of the ethoxylated alkyl sulfate surfactant has an average from about 8 to about 15 carbon atoms, and wherein the ethoxylated alkyl sulfate surfactant has an average degree of ethoxylation from about 1 to about 6.5.

* * * * *

UNITED STATES PATENT AND TRADEMARK OFFICE

CERTIFICATE OF CORRECTION

PATENT NO. : 5,607,910

DATED : March 4, 1997

INVENTOR(S) : Sherry et al.

It is certified that error appears in the above-indentified patent and that said Letters Patent is hereby corrected as shown below:

In Column 11, line 6 (21st line of Claim 1), the word "artionic" should read --anionic--.

Signed and Sealed this

Seventeenth Day of June, 1997

*Attest:*

*Attesting Officer*

BRUCE LEHMAN

*Commissioner of Patents and Trademarks*